United States Patent [19]

Yaegashi et al.

[11] Patent Number: 4,880,686

[45] Date of Patent: Nov. 14, 1989

[54] THERMAL TRANSFER MATERIAL

[75] Inventors: Hisao Yaegashi, Yokohama; Tetsuo Hasegawa, Tokyo; Naoki Kushida, Yokohama; Koichi Tohma, Kawasaki; Takayuki Suzuki, Saitma, all of Japan

[73] Assignee: Canon Kabushiki Kaisha, Tokyo, Japan

[21] Appl. No.: 106,819

[22] Filed: Oct. 13, 1987

[30] Foreign Application Priority Data

Oct. 17, 1986 [JP] Japan ..... 61-246605

[51] Int. Cl.[4] ..... B41M 5/26

[52] U.S. Cl. ..... 428/212; 428/195; 428/323; 428/327; 428/484; 428/488.1; 428/488.4; 428/913; 428/914

[58] Field of Search ..... 428/195, 212, 484, 488.1, 428/488.4, 913, 914, 323, 321

[56] References Cited

U.S. PATENT DOCUMENTS

| | | | |
|---|---|---|---|
| 1,776,141 | 9/1930 | Bibb | 428/914 |
| 4,229,239 | 10/1980 | Arai | 428/914 |
| 4,322,467 | 3/1932 | Heimbach | 428/200 |
| 4,407,686 | 10/1983 | Cook | 156/215 |
| 4,592,946 | 6/1986 | Shuman | 428/914 |
| 4,651,177 | 3/1987 | Morishita | 346/1.1 |

FOREIGN PATENT DOCUMENTS

| | | | |
|---|---|---|---|
| 3732222 | 4/1988 | Fed. Rep. of Germany | 428/488.4 |
| 64389 | 4/1984 | Japan | 428/488.1 |
| 59-224392 | 12/1984 | Japan | 428/488.4 |
| 131295 | 7/1985 | Japan | 428/488.4 |

*Primary Examiner*—Ellis P. Robinson
*Assistant Examiner*—P. K. Schwartz
*Attorney, Agent, or Firm*—Fitzpatrick, Cella, Harper & Scinto

[57] ABSTRACT

A thermal transfer material suitable for two-color recording comprises a support and at least a first adhesive layer, a first ink layer, and a second ink layer disposed in this order on the support. The adhesion strength $F_1$ between the support and the first ink layer and the adhesive strength $F_2$ between the first and second ink layers satisfy the relations of $F_1 > F_2$ at a higher temperature and $F_1 < F_2$ at a lower temperature. The first ink layer comprises a binder having a glass transition temperature (Tg) of 0° C. or below and 25–85 wt. % of a pigment. Two color recording is effected by superposing the thermal transfer material on plain paper, applying a pattern of heat and separating the thermal transfer material from the paper while changing the time from heating until the separation, i.e., temperatures at the time of separation. Sharp edge cutting of the heated portion is ensured by the definition of the composition of the first ink layer.

7 Claims, 3 Drawing Sheets

THERMAL TRANSFER MATERIAL

FIELD OF THE INVENTION AND RELATED ART

The present invention relates to a thermal transfer material for use in a recording method of transferring two-color images onto a recording medium such as plain paper.

The thermal or heat-sensitive transfer recording method has recently been widely used because it has general advantages of the thermal recording method such that the apparatus employed is light in weight, compact, free of noise, excellent in operability and adapted to easy maintenance, and also has other advantages such that it does not require a color-formation type converted paper but provides recorded images with excellent durability.

Further, there is also a commercial demand for a method of obtaining two-color images while retaining the advantages of the thermal transfer recording method as described above. Accordingly, there have been proposed several techniques for obtaining two-color images.

In order to obtain two-color images on plain paper by the thermal transfer recording method, Japanese Laid-Open Patent Application No. 148591/1981 discloses a two-color type thermal transfer recording element (transfer material) comprising a substrate and two heat-fusible ink layers including a high-melting point ink layer A and a low-melting point ink layer B containing mutually different colorants disposed in this order on the substrate. When a low thermal input energy is applied to the element, only the low-melting point layer B is transferred onto plain paper. On the other hand, when a high thermal input energy is applied to the element, both the heat-fusible ink layers A and B are transferred onto the plain paper. As a result, two-color images can be obtained.

Further, Japanese Laid-Open Patent Application No. 64389/1984 discloses a two-color thermal transfer ink sheet which comprises, on a substrate, an ink layer comprising an ink which melt-exudes at a lower temperature and another ink which is melt-peeled at a higher temperature than the melt-exudation temperature.

In the methods using the above-mentioned thermal transfer materials, two-color recording is effected by changing the energy applied to a thermal head at two levels so as to change the temperature of the ink layers. However, when a high energy is supplied to the ink layers to provide a high temperature, a lower temperature portion is formed at the periphery of a higher temperature portion due to heat diffusion, so that a bordering of a lower temperature color is formed around the higher temperature printed image. Further, when a high energy is supplied to a thermal head, it requires a relatively long time until the thermal head is cooled so that a higher-temperature printed image is liable to be accompanied with a trailing of a lower-temperature color. Further, in any of the above methods, there is a constraint that a relatively low melting material is required for providing an ink to be transferred at a lower temperature, whereby they give rise to problems such as ground soiling and low storability of the thermal transfer material.

As a technique for dissolving above-mentioned problems, our research group has proposed a recording method as disclosed in Japanese Laid-Open Patent Application No. 137789/1986 (U.S. Patent Application Serial No. 819,497). In this recording method, there is employed a thermal transfer material comprising a support and at least a first ink layer and a second ink layer disposed in this order on the support, and after heat is applied to the thermal transfer material, a length of time from the heat application until the separation between the transfer material and a recording medium is so controlled that the second ink layer is selectively, or both the first and second ink layers are, transferred to the recording medium.

Our research group has further proposed, as a thermal transfer material for use in such recording method, one as disclosed in Japanese Laid-Open Patent Application No. 295075/1986 and one as disclosed in Japanese Laid-Open Patent Application No. 295079/1986. Japanese Laid-Open Patent Application No. 295075/1986 discloses a thermal transfer material wherein at least one of a first ink layer and a second ink layer contains a silicone oil or a fluorine-containing surfactant so as to promote separation between the first and second ink layers. Japanese Laid-Open Patent Application No. 295079/1986 discloses a thermal transfer material wherein a fine powder layer not meltable under application of a heat energy for recording is disposed between a first ink layer and a second ink layer so as to easily cause separation therebetween.

The above-mentioned recording method disclosed in Japanese Laid-Open Patent Application No. 137789/1986 (U.S. Patent Application Serial No. 891,497), has solved the problems of bordering, trailing, etc., in the prior art. In this new two-color recording method, however, a further improvement in transferred image quality is still desired.

In order to obviate a problem that the first ink is mixed into an image of the second ink when the second ink layer is selectively transferred in the above recording method, our research group has also proposed to separate the thermal transfer material from a recording medium under the action of a peeling force of not less than 20 g-f (gram-force) and less than 200 g-f in a direction perpendicular to and leaving from the surface of the recording medium toward the thermal transfer material (U.S. Patent application Ser. No. 58,852).

The quality of a recorded image is also improved by promoting sharp edge-cutting of a transferred image. It is, however, not always easy to effect such sharp edge-cutting in a transfer operation because it is influenced by various actual recording conditions such as a heat-application condition and a peeling condition among others.

Incidentally, as a technique for improving the edge-cutting of a transferred image obtained in the above-mentioned recording method disclosed in Japanese Laid-Open Patent Application No 137789/1986 (U.S. Patent Application Ser. No. 891,497), our research group has proposed a thermal transfer material wherein the total ink layers on a support have a tensile strength in the range of 8–20 $kg/cm_2$, as disclosed in Japanese Patent Application No. 226823/1986.

SUMMARY OF THE INVENTION

A principal object of the present invention is to provide a thermal transfer material by which recorded images with sharp edges can be formed, and a first ink layer is not mixed into a transferred image of a record ink layer.

According to the present invention, there is provided a thermal transfer material, comprising: a support and at least a first adhesive layer, a first ink layer, and a second ink layer disposed in the order named on the support, wherein the adhesion strength $F_1$ between the support and the first ink layer and the adhesion strength $F_2$ between the first and second ink layers satisfy the relations of $F_1 > F_2$ at a higher temperature and $F_1 < F_2$ at a lower temperature, the first ink layer comprising a binder and a pigment, the binder having a glass transition temperature (Tg) of 0° C. or below, the pigment constituting 25 to 85 wt. % of the first ink layer.

These and other objects, features and advantages of the present invention will become more apparent upon a consideration of the following description of the preferred embodiments of the present invention taken in conjunction with the accompanying drawings, wherein like parts are denoted by like reference numerals. In the description appearing hereinafter, "part(s)" and "%" used for describing quantities are by weight unless otherwise noted specifically.

BRIEF DESCRIPTION OF THE DRAWINGS

FIGS. 2A and 2B are schematic sectional views each showing an appearance of transfer with respect to the thermal transfer material according to the present invention, wherein FIG. 2A shows a transfer of a first ink layer, and FIG. 2B shows a transfer of first and second ink layers;

DETAILED DESCRIPTION OF THE INVENTION

Figure 1:
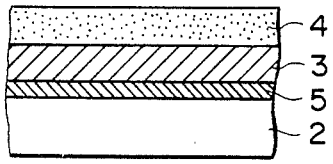
FIG. 1 is a schematic sectional view across the thickness of an embodiment of the thermal transfer material according to the present invention.

Referring to FIG. 1, a thermal transfer material 1 according to the present invention comprises a support 2, and a first adhesive layer 5, a first ink layer 3 and a second ink layer 4 disposed in this order on the support.

In the thermal transfer material of the present invention, it is essential that the adhesion (strength) $F_2$ between the first ink layer 3 and the second ink layer 4 and the adhesion (strength) $F_1$ between the first ink layer 3 and the support 2 satisfy the relations of $F_1 > F_2$ at a higher temperature and $F_1 < F_2$ at a lower temperature. When the transfer material of the present invention is supplied with heat, the separation between the first ink layer 3 and the second ink layer 4 is more readily caused than that between the first ink layer 3 and the support 2 immediately after the heating. On the other hand, the separation between the first ink layer 3 and the support 2 becomes relatively easier after a considerable time has passed from the heating until the separation of the support 2 from a recording medium, i.e., at the time when the transfer material is cooled after the transfer material and the recording medium has been superposed, heated and retained for a substantial time after heating and before peeling.

The above-mentioned characteristics of the respective layers will be further explained with reference to FIG. 3.

Figure 2A:
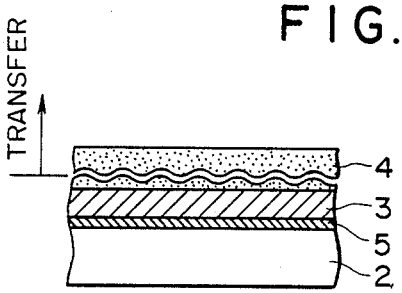
Figure 2B:
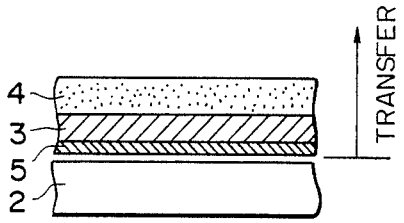

Incidentally, the relative adhesion between the second and first ink layers and that between the first ink layer and the support are evaluated according to such a standard that the latter adhesion is larger if the second ink layer is substantially selectively transferred (FIG. 2A), and that the former is larger if substantially both the ink layers are transferred (FIG. 2B), respectively, when transfer recording is effected on a recording medium. Such evaluation of the adhesions is not affected by the form of separation between ink layers (e.g., whether or not the separation between the second and first ink layers has occurred strictly at the boundary between these layers, etc.).

The adhesion ($F_2$) between the first ink layer 3 and the second ink layer 4, and the adhesion ($F_1$) between the first ink layer 3 and the support 2, change on heating and cooling. In the present invention, the first adhesive layer 5 is disposed between the first ink layer 3 and the support 2 in order to control the adhesion $F_1$ between these layers. The first adhesive layer 5 may preferably be one causing an irreversible decrease in the adhesion $F_1$ through heating.

Figure 3:
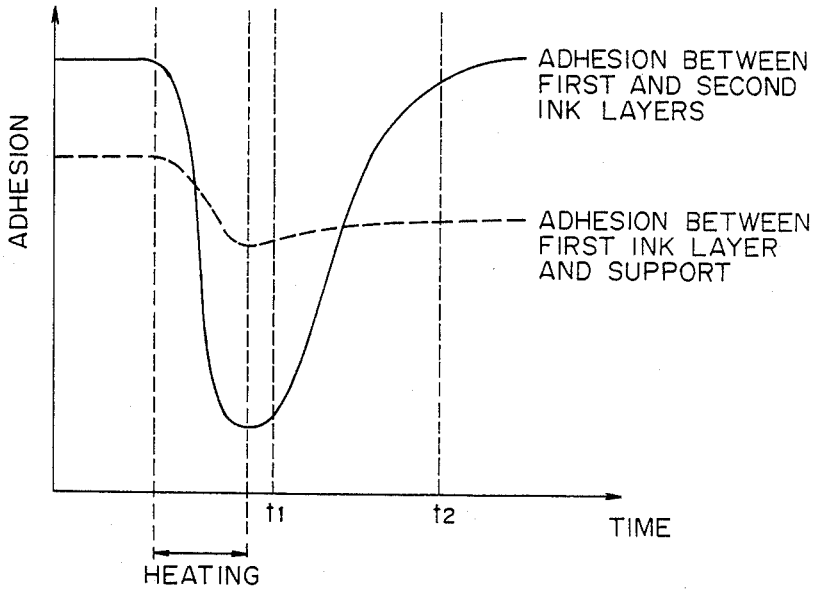
FIG. 3 is a graph showing a variation in adhesion strength between respective ink layers.

In the embodiment shown in FIG. 3, the adhesion $F_2$ between the first ink layer 3 and the second ink layer 4 decreases more sharply than the adhesion $F_1$ between the first ink layer 3 and the support 2 on temperature increase due to heating by a thermal head. As a result, the adhesion $F_2$ between the first ink layer 3 and the second ink layer 4 is weaker than the adhesion $F_1$ between the first ink layer 3 and the support 2, at a time immediately after heating (i.e., before the temperature being lowered). Accordingly, if the transfer material is peeled from the recording medium immediately after the transfer material is heated while the second ink layer 4 thereof being in contact with the recording medium, i.e., at a time $t_1$ in FIG. 3, only the second ink layer 4 is transferred to the recording medium.

In contrast, if the temperature of the, ink layer has been lowered when a little time has passed after heating, the adhesion $F_2$ is recovered to be essentially the same as that before heating. However, since the adhesion $F_1$ between the first ink layer 3 and the support 2 is irreversibly decreased through heating because of the first adhesive layer in this embodiment, the adhesion $F_1$ is not recovered to the state before heating. As a result, the adhesion $F_1$ between the first ink layer 3 and the support 2 is weaker than the adhesion $F_2$ between the first and second ink layers. Therefore, if the transfer material is peeled from the recording medium at this time, i.e., at a time $t_2$ in FIG. 3, the first ink layer 3 is transferred together with the second ink layer 4 to the recording medium.

Accordingly, if the first ink layer 3 and the second ink layer 4 are composed to have different color tones from each other in the thermal transfer material, two-color recording can be effected. When the color of the first ink layer 3 and the second ink layer 4 are desired to be obtained substantially as they are, it is preferred to dispose a first ink layer 3 of a dark color such as black and a second ink layer 4 of a brighter color than that of the first ink layer such as red. Further, the first and second ink layers can be made in the same hue but different in density from each other, whereby two-color images with dense and pale portions can be obtained in the same manner as described above. Further, the first ink layer can function as a correcting ink layer by incorporating, e.g., a white pigment having a strong hiding power therein.

As described above, in a case where both the first and second ink layers are transferred, the transfer material of the present invention is peeled from a recording medium at a lower temperature than that in a case where only the second ink layer is transferred. In this case, a heat-applied portion of the second ink layer adheres to the recording medium, but a non-heat-applied portion thereof does not adhere to the recording medium. As a result, the cutting in the second ink layer becomes clear to a certain extent at the boundary between the heat-applied portion and the non-heat-applied portion.

Therefore, in order to improve the edge-cutting of a transferred image, it is required that there is used an ink layer having a small tensile strength and a small tensile elongation at normal temperature. However, in a case where only the second ink layer is transferred, if the first ink layer is too brittle or fragile, the first ink layer is liable to be partially transferred onto a transferred image of the second ink layer, whereby a good separation of colors cannot be obtained. Therefore, the first ink layer is, required to have a cohesion above a certain level. As a result of our study, however, it is very difficult to attain these properties required for the first ink layer by composing it of a single substance.

In the present invention, the first ink layer comprises a binder which has a glass transition temperature of 0° C. or below, preferably −10° C. or below, and which preferably has a relatively large tensile elongation of 300% or above, more preferably 500% or above. In the first ink layer, a relatively large amount of a pigment is added to the binder, whereby the tensile elongation and tensile strength thereof are suppressed.

In the present invention, since the binder used in the first ink layer 3 has a glass transition temperature of 0° C. or below, the binder is always in the state of a kind of supercooled liquid in the time of printing and storage. As a result, the first ink layer does not show brittleness. Accordingly, the first ink layer 3 is not transferred partially when only the second ink layer 4 is intended to be transferred.

Further, the binder preferably has a relatively large tensile elongation. If the binder has a tensile elongation of below 300%, there are some cases wherein the first ink layer shows brittleness.

The tensile elongation used herein is the proportion of a change in length to an original length. The tensile elongation is based on values measured by using a sample in the form of a flat dumbbell having a thickness of 50 μm and a width (a narrow portion) of 6 mm, and using a tensile tester (Tensilon RTM-100, mfd. by Toyo Boldwin K.K.) at a pulling speed of 300 mm/sec and at room temperature (25° C.).

The binder used in the first ink layer 3 which satisfies the above-mentioned conditions may include: acrylate copolymers such as alkyl acrylates copolymers, acrylonitrile-alkyl acrylate copolymers, styrene-alkyl acrylate copolymers, and alkyl methacrylate-alkyl acrylate copolymers; latexes such as styrene-butadiene latexes, nitrile-butadiene latexes, acrylic latexes, and vinyl acetate latexes; urethane resins such as polyester urethanes, polyurethanes; etc. These binders ay be used singly or as appropriate mixtures. Further, as desired, another binder material such as waxes or resins or another additive may be added to the above-mentioned binders.

In the present invention, relatively small tensile strength and tensile elongation required for the first ink layer 3 may be realized by adding a relatively large amount of a pigment to the above binder.

The pigment content in the first ink layer 3, is 25–85%, preferably 35–70% based on the weight of the first ink layer, while the pigment content may desirably be optimized by changing it depending on the property of an adhesive layer or the second ink layer.

If the pigment content is below 25%, the decrease in the tensile strength and tensile elongation of the binder is insufficient. On the other hand, if the pigment content is above 85%, the first ink layer becomes brittle whereby the separation of colors is insufficient when only the second ink layer is intended to be transferred.

As the pigment contained in the first ink layer, known pigments may be used. Such pigments may for example include: carbon black, lamp black, Sudan Black SM, Alkali Blue, Fast Yellow G, Benzidine Yellow, Pigment Yellow, Indo Fast Orange, Irgadine Red, Paranitroaniline Red, Toluidine Red, Carmine FB, Permanent Bordeaux FRR, Pigment Orange R, Lithol Red 2G, Lake Red C, Rhodamine FB, Rhodamine B Lake, Methyl Violet B Lake, Phthalocyanine Blue, Pigment Blue, Brilliant Green B, Phthalocyanine Green, etc. Two or more of these pigments may be used in combination as desired.

In a case where a recording is effected by using the thermal transfer material according to the present invention, it is required that the relation in strength between the adhesion ($F_2$) between the first and second ink layers and the adhesion ($F_2$) between the first ink layer 3 and the support 2 is clearly reversed with respect to the time $t_1$ and the $t_2$ after heating. Therefore, in order to easily control the adhesion, a second adhesive layer 6 may be disposed, as desired, between the first ink layer 3 and second ink layer 4. In such a case, since the adhesion between the first ink layer 3 and the second ink layer 4 is controlled by the second adhesive layer 6, materials constituting the first and second ink layers, or the pigment content of these ink layers may be selected from a wider scope thereof.

Figure 5:
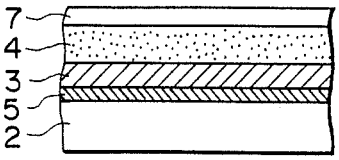

It is further possible to dispose a third adhesive layer 7 on the second ink layer 4 as a layer facing a recording medium as shown in FIG. 5. The third adhesive layer 7 strengthens the adhesion of the second ink layer 4 to the recording medium. The second ink layer 4 generally contains a proportion of a colorant so that it is difficult to remarkably increase the adhesion of the second ink layer 4 to the recording medium. Accordingly, the provision of the third adhesive layer 7 is advantageous, especially when two-color recording is effected on a recording medium with poor surface smoothness.

It is also possible to appropriately provide the above-mentioned second adhesive layer 6 and third adhesive layer 7 in combination, as desired.

The second ink layer 4 may be formed by dispersing a colorant in a binder (not intended to exclude a case where the colorant is dissolved in the binder).

The binders for constituting the second ink layer and the materials for constituting the first, second and third adhesive layers may be selected, as a single species or a combination of two or more species as desired, from the following materials: waxes including: natural waxes such as whale wax, beeswax, lanolin, carnauba wax, candelilla wax, montan wax and ceresin wax; petroleum waxes such as paraffin wax and microcrystalline wax; synthetic waxes such as oxidized wax, ester wax, low molecular weight polyethylene, Fischer-Tropsch wax and the like; higher fatty acids such as lauric acid, myristic acid, palmitic acid, stearic acid, and behenic acid; higher alcohols such as stearyl alcohol and behenyl alcohol; esters such as fatty acid esters of sucrose and fatty acid esters of sorbitane; amides such as oleic amide; or resins including: polyolefin resins, polyamide resins, polyester resins, epoxy resins, polyurethane resins, acrylic resins, polyvinyl chloride resins, cellulose resins, polyvinyl alcohol resins, petroleum resins, phenolic resins, polystyrene resins, vinyl acetate resins; elastomers such as natural rubber, styrene-butadiene rubber, isoprene rubber, chloroprene rubber; polyisobutylene, polybutene, etc.

Figure 4:
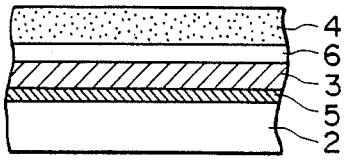
FIGS. 4 and 5 respectively show another embodiment of the thermal transfer material according to the present invention.

It is preferred that the second ink layer 4 is so composed as to provide a melt viscosity (by a rotary viscometer) in the range of 10 cps to 1,000,000 cps at a temperature which is 30° C. higher than the softening temperature of the second ink layer. In a case where the second adhesive layer 6 is disposed as shown in FIG. 4, it is preferred that the second adhesive layer 6 is so composed as to provide a melt viscosity similar to that of the above-mentioned second ink layer. Particularly, the second ink layer 4 should preferably have a melt viscosity of 200 cps or higher in consideration of an adhesion onto a recording medium such as paper.

The "softening temperature" used in the present invention is a flow initiation temperature as obtained from an apparent viscosity-temperature curve of a sample ink based on a measurement by a flow tester (Model: CFT500, available from Shimazu Seisakusho K.K.) under the conditions of a load of 10 kg, and a temperature increasing rate of 2° C./min.

The colorant content in the second ink layer may preferably be in the range of 1–90%, more preferably 10–50%.

The colorant contained in the second ink layer 4 may be selected from all of the known dyes and pigments including: in addition to the above-mentioned pigments, e.g., Oil Yellow GG, Zapon Fast Yellow CGG, Kayaset Y963, Kayaset YG, Smiplast Yellow C, Zapon Fast Orange RR, Oil Scarlet, Smiplast Orange G, Orasol Brown B, Zapon Fast Scarlet CG, Aizen Spiron Red BEH, Oil Pink OP, Victoria Blue F4R, Fastgen Blue 5007, Sudan Blue, and Oil Peacock Blue. Two or more of these colorant may be used in combination as desired. Further, metal powder such as copper powder and aluminum powder or powder or mineral such as mica may also be used as a colorant.

In a preferred embodiment of the thermal transfer material according to the present invention, the adhesion $F_1$ between the first ink layer 3 and the support 2 is irreversibly decreased through heating by providing the first adhesive layer 5. Such first adhesive layer 5 may preferably comprise a wax component A in the form of particulates and an adhesive component B.

In a case where the first adhesive layer 5 is composed in this manner, in a state thereof before heat-application, it is presumed that the adhesive component is present, as a binder, around the particulate wax component, and that the first adhesive layer 5 bonds the first ink layer 3 to the support 2 in such a state.

The particulate wax component in the first adhesive layer 5 is softened when once supplied with heat, and thereafter is formed into a film as it is cooled. As a result, the first adhesive layer 5 is controlled by the film-formed wax component to decrease its flexibility, whereby the releasability thereof becomes stronger than the adhesive of the adhesive component.

Thus, the first adhesive layer 5 may be so composed that the adhesion thereof irreversibly changes. More specifically the adhesion of the first adhesive layer decreases from an initial adhesion before heat-application to an adhesion after the heat-application, and does not completely recover to the initial state. In such first adhesive layer 5, the weight of the wax component is more than that of the adhesive component.

In order to enhance the above-mentioned effect, the particulate wax component A may preferably comprise a wax having a softening temperature of 60–150° C. The wax component A may preferably provide a melt viscosity (by a rotary viscometer) in the range of 10,000 cps to 1,000,000cps at 120° C. Further, the particulate wax component A may preferably have a number-average particle size of about 0.5–5 μm.

The wax component may be selected, as a single species or a combination of two or more species as desired, from the following materials: natural waxes such as whale wax, beeswax, lanolin, carnauba wax, candelilla wax, montan wax and ceresin wax; petroleum waxes such as paraffin wax and microcrystalline wax; synthetic waxes such as ester wax, low molecular weight polyethylene, Fischer-Tropsch wax and the like; higher fatty acids such as lauric acid, myristic acid, palmitic acid, stearic acid, and behenic acid; higher alcohols such as stearyl alcohol and behenyl alcohol; esters such as fatty acid esters of sucrose and fatty acid esters of sorbitane; amides such as oleic amide; etc.

If a wax having a softening temperature of below 60° C. is used, the particulate characteristics thereof may be lost gradually in a storage state, or may cause an offset of the ink layer in storage at a high temperature (at about 60° C.). On the other hand, if a wax having a softening temperature of above 150° C. is used, the quantity of heat applied in a recording may be insufficient and cannot cause a sufficiently melted state whereby it is difficult to cause an intended irreversible change.

The adhesive component B may preferably have a tensile stength of 100 kg/cm$^2$ or below at room temperature (25° C.). The tensile strength used herein may be measured in the same manner as in the above-mentioned tensile elongation.

The adhesive component B may be selected, as a single species or a combination of two or more species as desired, from the following materials: polyamide resins, polyester resins, epoxy resins having an extremely high molecular weight, acrylic resins (e.g., polymethyl methacrylate, polyacrylamide, etc.), vinyl resins such as polyvinyl pyrrolidone, polyvinyl chloride resins (e.g., vinyl chloride-vinylidene chloride copolymers, vinyl chloride-vinyl acetate copolymers, etc.), cellulose resins (e.g., methyl cellulose, ethyl cellulose, carboxymethyl cellulose, etc.), polyvinyl alcohol resins (e.g., polyvinyl alcohol, partially saponified polyvinyl alcohol, etc.), petroleum resins, rosin derivatives, coumarone-indene resins, terpene resins, novolak-type phenolic resins, polystyrene resins, polyolefin resins (e.g., polyethylene, polypropylene, polybutene, ethylene-vinyl acetate copolymers, etc.), polyvinyl ether resins, polyethylene glycol resins; and elastomers, natural rubbers, styrene-butadiene rubbers, isoprene rubbers, etc.

Among these, there may preferably be used ethylene-vinyl acetate copolymers, vinyl acetate-ethylene copolymers, and alkyl acrylates copolymers.

An ethylene-vinyl acetate copolymer as the adhesive component may preferably contain 60–90% of ethylene, more preferably 70–80% of ethylene. A vinyl acetate-ethylene copolymer as the adhesive component may preferably contain 10–40% of ethylene, more preferably 15–30% of ethylene.

Further, an alkyl acrylates copolymer as the adhesive component may preferably have a glass transition temperature of 0° C. or below, more preferably −30° C. or below, particularly preferably −50° C. or below. If the glass transition temperature is above 0° C., e.g., at about room temperature, it is difficult to stably store the thermal transfer material.

In case where the first and second ink layers are disposed contiguous with each other, they are preferably composed of binders comprising materials which are mutually insoluble. When the first ink layer 3 comprises a resin-type binder, the second ink layer 4 may preferably comprise at least 30 parts or more, more preferably 50 parts or more of a wax-type binder per 100 parts of the total binder.

Figure 6:
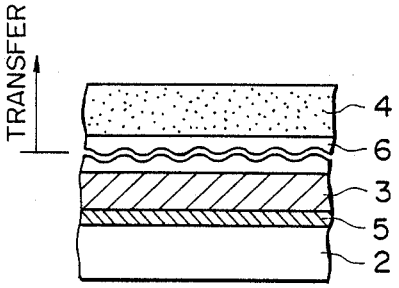
FIG. 6 is a schematic sectional view showing an appearance of transfer of the second ink layer with respect to the thermal transfer material shown in FIG. 4.

On the other hand, in case where the first ink layer 3 and the second ink layer 4 are not contiguous with each other, i.e., where the second adhesive layer 6 (FIG. 4) is provided, the constraint of desirably using a wax in the second ink layer 4 is removed. In this case, however, it is desirable for the second adhesive layer 6 to contain 50% or more of a wax. More specifically, by adopting this arrangement, the second ink layer 4 is selectively transferred through breakage or separation within the second adhesive layer 6, as shown in FIG. 6, in order to obtain a recorded image of the second ink layer. Accordingly, the structure shown in FIG. 4 is advantageous as compared with a structure not having a second adhesive layer 6, in that no separation is caused within the second ink layer 4 and therefore no fluctuation in density of recorded images results.

The first adhesive layer 5, the second adhesive layer 6, or the third adhesive layer 7 may contain a colorant as desired. Further, other additives such as surfactants, plasticizers, mineral oils, vegetable oils, fillers, etc., may also be added to the first adhesive layer 5, the first ink layer 3, the second ink layer 4, or the second adhesive layer 6 or third adhesive layer 7 provided as desired.

As the support 2 of the thermal transfer material, it is possible to use films of, e.g., polyester, aramide resin, nylon, polycarbonate, or as capacitor paper, preferably having a paper such as capacitor paper, preferably having a thickness of about 3 to 12 μm. Too thick a support is not desirable because the heat conductivity becomes inferior. If a sufficient heat resistance and a strength are attained, a support can be thinner than 3 μm. It is sometimes advantageous to coat the back surface (opposite to the face on which the ink layers are disposed) with a layer for supplementing the heat resistance.

In the thermal transfer material of the present invention, the ink layers and the adhesive, layers on the support 2 may preferably have a thickness of not exceeding 20μm in total. Further, it is preferred that each of the first ink layer 3, second ink layer 4, first adhesive layer 5, second adhesive layer 6 and third adhesive layer 7 has a thickness in the range of 0.5–10 μm.

As a heating means for the thermal transfer recording method using the thermal transfer material of the present invention, ordinary heat sources such as infrared rays and laser beam may also be used in place of a thermal head. Further, in order to provide a conduction heating system, i.e., a system wherein a thermal transfer material itself generates a heat due to a current passing therethrough, a thin layer of a conductive material such as aluminum may be disposed as a return electrode between the support 2 and the first adhesive layer 5 or the ink layer per se may be made conductive, as desired.

The thermal transfer material of the invention may be obtained by forming the respective layers by mixing the materials constituting the respective layers and an organic solvent such as methyl ethyl ketone, xylene and tetrahydrofuran capable of dissolving the binders and applying the thus formed coating liquids successively on the support. Alternatively, the so-called hot-melt coating method may be adopted, including the steps of blending, hot-melting and applying, the materials in a molten state for the respective layers. The materials for the respective layer may be formed into aqueous emulsions by the addition of a dispersant such as a surfactant, and the aqueous emulsions may be applied to form the respective layers. Further, the respective layers of the transfer material may also be formed by using the above mentioned coating methods in combination, i.e., by using different methods for the respective layers.

In a case where the first adhesive layer 5 comprises the wax component A and the adhesive component B, the particulate wax component may preferably be dispersed in the adhesive component to form a coating mixture, which is then applied to form the first adhesive layer. Alternatively, these components may preferably be formed into aqueous emulsion by the addition of a dispersant such as a surfactant, and the aqueous emulsion may be applied to form the first adhesive layer. Such methods may preferably be adopted in order to fully exhibit the characteristics of the above-mentioned particulate wax component.

Now, a method of two-color recording effected by using the thermal transfer material of the present invention will be explained.

Incidentally, in an embodiment described hereinbelow, a thermal head is used as the most, typical heat source, and a thermal transfer material having a structure shown in FIG. 4 and having a characteristic shown in FIG. 3 is used.

Figure 7:
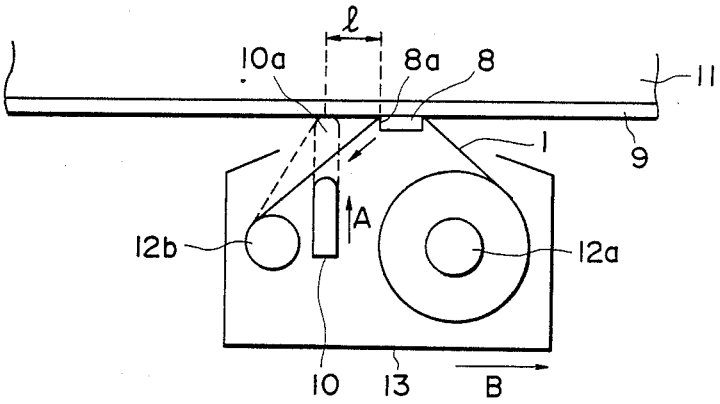
FIG. 7 is a schematic sectional view for illustrating a thermal transfer recording apparatus using a thermal transfer material according to the present invention.

Referring to FIG. 7, a thermal transfer material 1 of the present invention wound off from a supplying roller **12*a* is moved to a heat-applying position, where it is pressed against a recording medium 9 supported by a platen 11 by means of a thermal head 8 so that the second ink layer thereof contacts the recording medium and simultaneously a pattern of heat is applied to the thermal transfer material 1 from the thermal head 8. The thermal head 8 is moved rightward (i.e., in the direction of an arrow B). The thermal transfer material 1 is wound off from the supplying roller 12*a* and wound up about a windup roller 12*b* in synchronism with the movement of the thermal head 8**.

Figure 8:
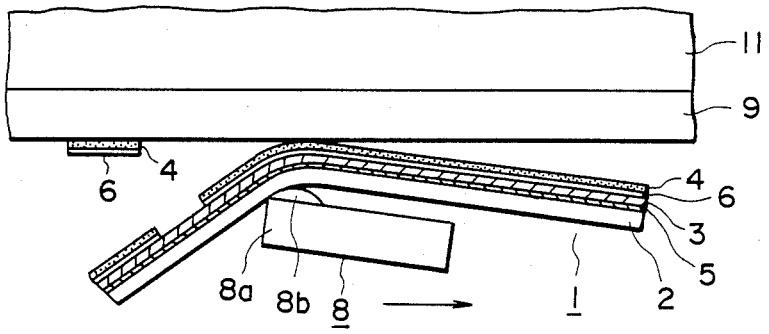
FIGS. 8 and 9 are enlarged schematic sectional views each showing the vicinity of a thermal head 8 shown in FIG. 7.

If the thermal transfer material 1 is peeled from the recording medium 9 at the rear end **8*a* of the thermal head 8 having a heat-generating part 8*b* immediately after the heat application therefrom, the second ink layer is selectively transferred to the recording medium 9 as shown in FIG. 8 because $F_1 > F_2$. This peeling immediately after the heat application corresponds to the time $t_1$ shown in FIG. 3**.

Figure 9:
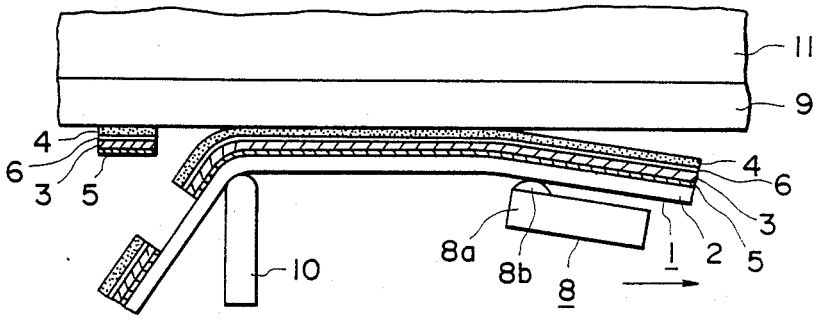

On the other hand, when a peeling-control member 10 is moved in the direction of an arrow A to a position 10*a* indicated by dashed lines, the thermal transfer material 1 and the recording medium 9 are pressed against each other, a pattern of heat is supplied from the thermal head 8, and the thermal transfer material 1 is peeled from the recording medium 9 as shown in FIG. 9, both the first and second ink layers are transferred to the recording medium 9 because $F_1 < F_2$.

The member 10 is, for example, disposed on a carriage 13 of a heat-sensitive transfer recording apparatus. The member 10 moves in association with the thermal head 8 while retaining a distance 1, from the head 8, and can be moved, as desired, toward and away from the transfer material. More specifically, when the pressing member 10 is moved away, the transfer material 1 is peeled off from the recording medium 9, immediately after the thermal head 8 has passed by as shown in FIG. 8. In contrast, when the member 10 is pushed toward the recording medium 9 as shown in FIG. 9, the transfer material 1 is kept in contact with the recording medium 9 for some time after the thermal head 8 has passed by to give a longer period from the time when a heat energy is applied to the transfer material 1 until the time when the transfer material 1 is peeled off.

As described hereinabove, in the thermal transfer material according to the present invention the binder constituting the first ink layer have a glass transition temperature of 0° C. or below, whereby the first ink layer has a suitably large tensile elongation and is not brittle. As a result, when the second ink layer is selectively transferred by using the thermal transfer material according to the present invention, the first ink layer is not mixed into a transferred image of the second ink layer.

Further, since the first ink layer contains 25–85 wt. % of a pigment, the tensile elongation of the first ink layer is not excessively large. As a result, the thermal transfer material of the present invention provides sharp edge-cutting of a transferred image.

Hereinbelow, the present invention will be explained more specifically while referring to specific examples of practice. Incidentally, the glass transition temperature (Tg) of a sample was measured by means of a differential scanning calorimeter (DSC7, mfd. by Perkin-Elmer Co.) at a temperature increasing rate of 1° C./min., and the number-average molecular weight Mn of oxidized polyethylene was measured in the following manner.

Molecular Weight Measurement

The VPO method (Vapor Pressure Osmometry Method) is used. A sample of oxidized polyethylene, is dissolved in a solvent such as benzene at various concentrations (C) in the range of 0.2 to 1.0 g/100 ml to prepare several solutions. The osmotic pressure ($\pi/C$) of each solution is measured and plotted versus the concentration to prepare a concentration (C)-osmotic pressure ($\pi/C$) curve, which is extrapolated to obtain the osmotic pressure at the infinite dilution $(\pi/C)_0$. From the equation of $(\pi/C)_0 = RT/Mn$, the number-average molecular weight Mn of the sample is derived.

EXAMPLE 1

<Ink 1>

| | |
|---|---|
| Oxidized polyethylene aqueous dispersion (Mn = 4000, softening temp. = 125° C., particle size = 1 μm) | 80 parts |
| Alkyl acrylate copolymer aqueous dispersion (Acronal YJ-8501D supplied from Mitsubishi Yuka Badische K.K.) | 20 parts |

(The amounts of aqueous dispersions for providing an ink formulation in this example and the other examples are all expressed based on their solid contents. Further, Mn, Tg, softening temperature, tensile elongation, melt viscosity, and ethylene content are all those of solid contents.)

The above components were sufficiently mixed to prepare an ink 1. The ink 1 was applied on, a 5 μ-thick PET (polyethylene terephthalate) film and dried at 60° C. to form a 1 μ-thick first adhesive layer.

<Ink 2>

| | |
|---|---|
| Alkyl acrylates copolymer aqueous dispersion (Acronal YJ-8501D supplied from Mitsubishi Yuka Badische K.K., Tg ≈ −60° C., tensile elongation = 2000%) | 50 parts |
| Carbon black aqueous dispersion | 20 parts |

The above components were sufficiently mixed to prepare an ink 2, which was applied on the above prepared first adhesive layer and dried at 80° C. to form a 2 μm-thick first ink layer.

<Ink 3>

| | |
|---|---|
| Carnauba wax aqueous dispersion (melt viscosity = 20 cps at 120° C.) | 100 parts |

The above ink 3 was applied on the above prepared first ink layer and dried at 60° C. to form a 1 μm-thick second adhesive layer.

<Ink 4>

| | |
|---|---|
| Oxidized polyethylene aqueous dispersion (Mn = 2000, softening temp. = 120° C.) | 80 parts |
| Ethylene-vinyl acetate copolymer aqueous dispersion (ethylene content = 20%, softening temp. = 119° C.) | 20 parts |
| Cyanine blue aqueous dispersion | 25 parts |

The above components were sufficiently mixed to prepare an ink 4 which was applied on the above prepared second adhesive layer and dried at 80° C. to form a 2 μm-thick second ink layer, whereby a thermal transfer material (I) was obtained

EXAMPLE 2

A thermal transfer material (II) was prepared in the same manner as in Example 1 except that a urethane resin aqueous dispersion (trade name: Superflex H8923E, mfd. by Daiichi Kogyo Seiyaku K.K., Tg=−50° C., tensile elongastion =1500%) was used instead of the alkyl acrylates copolymer aqueous dispersion used for the first ink layer in Example 1.

EXAMPLE 3

A thermal transfer material (III) was prepared in the same manner as in Example 1 except that an alkyl acrylates copolymer aqueous dispersion (trade name: Nipon LX811, mfd. by Nippon Zeon K.K., Tg =−18° C., tensile elongation =400%) was used instead of the alkyl acrylates copolymer aqueous dispersion used for the first ink layer in Example 1.

EXAMPLE 4

<Ink 5>

| | |
|---|---|
| Alkyl acrylate copolymer aqueous dispersion (Acronal YJ-8501D supplied from Mitsubishi Yuka Badische K.K., Tg ≈ −60° C., tensile elongation = 2000%) | 65 parts |
| Carbon black aqueous dispersion | 35 parts |

The above components were sufficiently mixed to prepare an ink 5.

A thermal transfer material (IV) was prepared in the same manner as in Example 1 except that the above ink 5 was used to form a first ink layer instead of the ink 2 used for the first ink layer in Example 1.

EXAMPLE 5

<Ink 6>

| | |
|---|---|
| Alkyl acrylates copolymer aqueous dispersion (Acronal YJ-8501D supplied from Mitsubishi Yuka Badische K.K., Tg ≈ −60° C., tensile elongation = 2000%) | 25 parts |
| Carbon black aqueous dispersion | 75 parts |

The above components were sufficiently mixed to prepare an ink 6. A thermal transfer material (V) was prepare in the same manner as in Example 1 except that the above ink 6 was used to form a first ink layer instead of the ink 2 used for the first ink layer in Example 1.

EXAMPLE 6

<Ink 7>

| | |
|---|---|
| Oxidized polyethylene aqueous dispersion (Mn = 4000, softening temp. = 125° C., particle size = 1 μm) | 70 parts |
| Ethylene-vinyl acetate copolymer aqueous dispersion (ethylene content = 70%, softening temp. = 90° C.) | 30 parts |

The above components were sufficiently mixed to prepare an ink 7.

A thermal transfer material (VI) was prepared in the same manner as in Example 1 except that the above ink 7 was used to form a first adhesive layer instead of the ink 1 used for the first adhesive layer in Example 1.

COMPARATIVE EXAMPLE 1

A thermal transfer material (VII) was prepared in the same manner as in Example 1 except that an alkyl acrylates copolymer aqueous dispersion (Acronal 295DN supplied from Mitsubishi Yuka Badische K.K., Tg =20° C.) was used instead of the alkyl acrylates copolymer aqueous dispersion used for the first ink layer in Example 1.

COMPARATIVE EXAMPLE 2

A thermal transfer material (VIII) was prepared in the same manner as in Example 1 except that 10 parts of the carbon black aqueous dispersion was used instead of 50 parts thereof used for the first ink layer in Example 1. Incidentally, the amount of the alkyl acrylates copolymer aqueous dispersion was the same as in Example 1.

COMPARATIVE EXAMPLE 3

<Ink 8>

| | |
|---|---|
| Alkyl acrylates copolymer aqueous dispersion (Acronal YJ-8501D supplied from Mitsubishi Yuka Badische K.K., Tg ≈ −60° C., tensile elongation = 2000%) | 10 parts |
| Carbon black aqueous dispersion | 90 parts |

The above components were sufficiently mixed to prepare an ink 8.

A thermal transfer material (IX) was prepared in the same manner as in Example 1 except that the above ink 8 was used to form a first ink layer instead of the ink 2 used for the first ink layer in Example 1.

Then, the above prepared thermal transfer materials (I) to (IX) were respectively used for recording by means of a thermal transfer recording apparatus for an English typewriter (Typestar 6, mfd. by Canon K.K.). Referring to FIG. 7, as a thermal head 8, one prepared by Rohm K.K., having a length from the center of the heat generating part **8*b* to the trailing end 8*a* (as shown in FIG. 8) of 350 μm was used. A carriage 13 loading the thermal head, 8 and thermal transfer material 1 was moved in the direction of an arrow B, at a moving velocity of 50 mm/sec. As a result, the time from heating until the peeling-off of the thermal transfer material 1 from a recording medium 9 was about 7 msec in the rapid peeling-off mode. In order to delay the time of the peeling, a control member 10 for controlling the peeling was disposed at about 5 mm (i.e., l=5 mm as shown in FIG. 7) after the trailing end 8*a* of the thermal head 8 (i.e., downstream side of the trailing end 8*a* with respect to the moving direction of the thermal transfer material 1**).

As a result, when the control member 10 was moved toward the recording medium 9, the delayed time of peeling-off was about 100 msec after the heating. Incidentally, it was confirmed that the result of the recording was not substantially different from the case of l=5 mm, even if the position of the control member 10 was changed in the range of from 2 mm to 20 mm (i.e., l=2−20 mm) after the trailing end **8*a* of the thermal head 8**.

When the transfer recording was conducted on plain paper by the use of the thermal transfer materials (I) to (VI), blue images were obtained if the transfer material was peeled rapidly and black images were obtained if the transfer material was peeled at the delayed time.

When the thermal transfer materials (I), (II) and (VI) were used, the blue images were sufficiently good for practical use and further the edge-cutting of the black images were stably effected thereby to obtain good black images.

When the thermal transfer materials (III) and (V) were used, the blue images were similar to those in the case of the thermal transfer material (I) and were sufficiently good for practical use. The black images sufficiently good for practical use, while they were slightly thickened and the edge-cutting thereof was slightly indented.

When the thermal transfer material (IV) was used, the blue image was similar to that in the case of the thermal transfer material (I) and sufficiently good for practical use. On the other hand, the black image was sharp and good while it was slightly thinner than that in the case of the thermal transfer material (I).

When the thermal transfer material (VII) of Comparative Example 1 was used, black color was mixed into the blue recorded images.

When the thermal transfer material (VIII) of Comparative Example 2 was used, the edge-cutting of the black images was bad, and even a portion of the ink layer not supplied with heat was also transferred to the recording medium.

When the thermal transfer material (IX) of Comparative Example 3 was used, fine dots of black color were mixed into the blue recorded images, and the blue images were hard to see. Further, the black images provided by the thermal transfer material (IX) were further thicker than those provided by the thermal transfer material (III), and they were also hard to see because of further indented edges.

What is claimed is:

1. A thermal transfer material, comprising: a support and at least a first adhesive layer, a first ink layer and a second ink layer disposed in the order named on the support, wherein the adhesion strength ($F_1$) between the support and the first ink layer and the adhesion strength ($F_2$) between the first and second ink layers satisfy the relationships $F_1 > F_2$ at a higher temperature and $F_1 < F_2$ at a lower temperature; said first ink layer comprising a binder and a pigment, said binder having a glass transition temperature (tg) of 0° C. or below, said pigment constituting 25 to 85 wt. % of the first ink layer and said first adhesive layer comprising a particulate wax component and an adhesive component wherein said particulate wax component constitutes a larger proportion by weight of the first adhesive layer than the adhesive component; said particulate wax component having a softening temperature of 60°–150° C. and comprising at least one wax selected from the group consisting of whale wax, beeswax, lanolin, carnauba wax, candelilla wax, montan wax, ceresin wax, paraffin wax, microcrystalline wax, ester wax, low-molecualr weight polyethylene or oxidized polyethylene, Fischer-Tropsch wax, lauric acid, myristic acid, palmitic acid, stearic acid, behenic acid, stearyl alcohol, behenyl alcohol, fatty acid ester of sucrose, fatty acid dester of sorbitane, and oleic amide.

2. A thermal transfer material according to claim 1, wherein said binder of the first ink layer has a glass transition temperature of −10° C. or below.

3. A thermal transfer material according to claim 1, wherein said binder of the first ink layer has a tensile elongation of 300% or larger.

4. A thermal transfer material according to claim 3, wherein said binder of the first ink layer has a tensile elongation of 500% or larger.

5. A thermal transfer material according to claim 1, wherein said pigment constitutes 35–70 wt. % of the first ink layer.

6. A thermal transfer material according to claim 1, which further comprises a second adhesive layer between the first and second ink layers.

7. A thermal transfer material according to claim 6, wherein said second adhesive layer comprises 50 wt. % or more of a wax.

* * * * *

UNITED STATES PATENT AND TRADEMARK OFFICE

CERTIFICATE OF CORRECTION

PATENT NO. : 4,880,686

DATED : November 14, 1989

INVENTOR(S) : Yaegashi, et al.

It is certified that error appears in the above-identified patent and that said Letters Patent is hereby corrected as shown below:

ON THE TITLE PAGE,

[56] References Cited:

Line 3, "4,322,467 3/1932 Heimbach..." should read --4,322,467 3/1982 Heimbach...--.

COLUMN 4:

Line 47, "the," should read --the--.

COLUMN 9:

Line 56, " as capacitor paper, preferably having a" should be deleted.

Line 66, "adhesive," should read --adhesive--.

COLUMN 10:

Line 23, "applying," should read --applying--.

Line 25, "layer" should read --layers--.

Line 48, "most," should read --most--.

UNITED STATES PATENT AND TRADEMARK OFFICE

CERTIFICATE OF CORRECTION

PATENT NO. : 4,880,686

DATED : November 14, 1989

INVENTOR(S) : Yaegashi, et al.

It is certified that error appears in the above-identified patent and that said Letters Patent is hereby corrected as shown below:

COLUMN 11:

Line 33, "have" should read --has--.

Line 58, "polyethylene," should read --polyethylene--.

COLUMN 13:

Line 41, "ink 6. A thermal" should read
--ink 6.
A thermal-- (begin a new paragraph).

COLUMN 14:

Line 39, "head," should read --head--.

UNITED STATES PATENT AND TRADEMARK OFFICE

CERTIFICATE OF CORRECTION

PATENT NO. : 4,880,686 Page 3 of 3

DATED : November 14, 1989

INVENTOR(S) : Yaegashi, et al.

It is certified that error appears in the above-identified patent and that said Letters Patent is hereby corrected as shown below:

COLUMN 16:

Line 3, "transition temperature (tg)" should read --transition temperature (Tg)--.

Line 18, "fatty acid dester" should read --fatty acid ester--.

Signed and Sealed this

Sixth Day of August, 1991

*Attest:*

HARRY F. MANBECK, JR.

*Attesting Officer*

*Commissioner of Patents and Trademarks*